US006761498B1

(12) United States Patent
Harris, Jr. et al.

(10) Patent No.: US 6,761,498 B1
(45) Date of Patent: Jul. 13, 2004

(54) BINDER CONSTRUCTION FOR EASY INSERTION AND REMOVAL OF SPINE LABEL

(75) Inventors: Charles K. Harris, Jr., Meridian, MS (US); Jack B. Harrison, Little Rock, MS (US); Richard K. Joyner, Meridian, MS (US); Brian King, Brea, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 10/406,069

(22) Filed: Apr. 2, 2003

(51) Int. Cl.[7] ..... B42F 13/00

(52) U.S. Cl. ..... 402/73; 281/15.1; 402/80 R; D19/26

(58) Field of Search ..... 402/73, 80 R, 402/502; 281/15.1, 36; D19/26, 27, 33

(56) References Cited

U.S. PATENT DOCUMENTS

| | | | | | |
|---|---|---|---|---|---|
| 743,831 | A | | 11/1903 | Cota | |
| 1,431,714 | A | | 10/1922 | Wilking | |
| 1,677,277 | A | | 7/1928 | Federbush et al. | |
| 1,805,314 | A | | 5/1931 | Morton | |
| 1,965,679 | A | | 7/1934 | Welliver et al. | |
| 2,051,907 | A | | 8/1936 | Schade | |
| 2,150,474 | A | | 3/1939 | Williams | |
| 2,304,980 | A | | 12/1942 | Williams et al. | |
| 2,544,566 | A | | 3/1951 | Rose | |
| 2,852,275 | A | | 9/1958 | Brook | |
| 2,977,698 | A | | 4/1961 | Chamberlin | |
| 3,039,472 | A | | 6/1962 | Duncan | |
| 3,066,680 | A | | 12/1962 | Duncan | |
| 3,111,949 | A | | 11/1963 | Duncan et al. | |
| 3,133,750 | A | | 5/1964 | Gerald | |
| 3,195,924 | A | | 7/1965 | Carter et al. | |
| 3,262,454 | A | | 7/1966 | Shillinger | |
| 3,335,508 | A | | 8/1967 | Hummel | |
| 3,335,510 | A | | 8/1967 | Littler | |
| 3,663,041 | A | | 5/1972 | White | |
| 3,807,883 | A | | 4/1974 | Karlsson | |
| 4,190,374 | A | | 2/1980 | Lindell | |
| 4,219,951 | A | | 9/1980 | Schmidt | |
| 4,294,469 | A | | 10/1981 | Errichiello | |
| 4,315,642 | A | | 2/1982 | Errichiello | |
| 4,600,346 | A | | 7/1986 | Podosek | |
| D285,313 | S | | 8/1986 | Maune | |
| 4,795,194 | A | | 1/1989 | Etheredge | |
| 4,931,346 | A | | 6/1990 | Nogueras Dardina | |
| 4,998,840 | A | * | 3/1991 | Ruble | 402/3 |
| 5,030,027 | A | * | 7/1991 | Bachrach et al. | 402/4 |
| 5,163,768 | A | | 11/1992 | Salisbury et al. | |
| 5,330,279 | A | * | 7/1994 | Ruble | 402/3 |
| 5,368,333 | A | | 11/1994 | Arroyo | |
| 5,711,627 | A | | 1/1998 | Chapman | |
| 5,720,564 | A | * | 2/1998 | Winzen | 402/3 |
| 5,785,445 | A | | 7/1998 | Podosek et al. | |
| 6,019,540 | A | * | 2/2000 | Senior | 283/81 |
| 6,076,989 | A | | 6/2000 | Pearce et al. | |
| 6,109,812 | A | | 8/2000 | Welch | |
| 6,267,412 | B1 | * | 7/2001 | Henderson | 281/15.1 |
| 6,290,421 | B1 | | 9/2001 | Welch | |
| 2003/0006603 | A1 | * | 1/2003 | Pontecorvo | 281/31 |

* cited by examiner

*Primary Examiner*—Monica S. Carter
(74) *Attorney, Agent, or Firm*—Fulwider Patton Lee & Utecht, LLP; Joel D. Voelzke

(57) ABSTRACT

In a binder such as a window binder having two opaque thermoplastic sheets sandwiching therebetween front and rear panels and a spine panel and an outer clear thermoplastic panel forming a window over at least the spine, the outer surface of the spine panel has a depression formed in it such that the spine is thicker or otherwise raised near its vertical edges, and thinner or otherwise depressed between the raised portions. The opaque sheet covering the outward face of the spine panel is sufficiently flexible so as to deflect inwardly into the depression in the spine panel. The deflection of the thermoplastic sheet into the spine depression allows a spine label to be inserted into the pocket between the thermoplastic sheet with relatively little force.

22 Claims, 3 Drawing Sheets

BINDER CONSTRUCTION FOR EASY INSERTION AND REMOVAL OF SPINE LABEL

RELATED APPLICATIONS

None

FIELD OF THE INVENTION

The present invention relates to binder construction. More particularly, the present invention relates to a construction of a binder such as a ring binder in which the spine label has been modified to allow easy insertion of a spine label.

BACKGROUND OF THE INVENTION

Binders such as ring binders are commonly fabricated in a three-ply construction. In this construction, three rigid or semirigid rectangular inserts or stiffener panels are heat-sealed between two sheets of cover material. Of the three stiffener panels generally used, two of them approximate in size the back and front panels of the binder. The third panel is a narrower insert strip disposed between the two larger panels to form the spine panel of the binder. The inner and outer plastic sheets are fused together or heat-sealed around their peripheral edges. The sheets are also sealed transversely between the adjacent, transverse edges of the cover panel inserts and the spine panel inserts. The transverse seals form the hinge areas of the binder. U.S. Pat. No. 3,195,924 is typical of this type of binder construction.

The stiffener panels are typically made of relatively thick, relatively rigid material, such as cardboard, fiberboard or corrugated paper, which is commonly referred to as chipboard. The chipboard may be made of solid chipboard material or may be of a laminate construction such as disclosed in U.S. Pat. No. 4,931,346. The inner cover and the outer cover may be made of a thin sheet of any fabric, paper or plastic material, but most commonly are made of a thermoplastic material, such as polyvinyl chloride (PVC) or polypropylene, that is readily joined at the edges of the inner and outer covers along the periphery of the substrate by heat welding, or by electronic welding, such as ultrasonic or radio frequency (RF) welding. The above type of ring binder—frequently referred to in the art as a "plastic binder"—is typically made as follows: First, a pair of matching sheets of opaque thermoplastic material, typically PVC, are positioned on opposite sides of one or more stiffening members arranged to define a front cover panel, a spine panel and a rear cover panel. Next, the sheets are welded together, typically by RF welding, around their respective peripheries. In addition, the sheets are also typically RF welded together along a pair of hinge lines on opposite sides of the spine panel. Finally, a paper-retaining ring mechanism, typically a 3-ring mechanism that either snaps open and closed via a spring loaded mechanism, or which opens and closes via a locking mechanism, is attached to either the spine or to one of the covers. Looseleaf ring binder covers in accordance with the above description are shown for example in U.S. Pat. Nos. 4,600,346 and 5,785,445, which are hereby incorporated by reference for their teachings of binder construction.

The binder can also have a clear or transparent cover such as a plastic cover over the outside to hold and protect front and/or rear cover labels and a spine label. In this construction, the clear sheet covers most of the outside of the binder. The clear sheet is sealed to the opaque PVC sheets at its vertical edges and its bottom edge, and is sealed to the hinges, typically by the same sealing technique as is used to seal the opaque sheets together, and typically at the same time. The space between the clear sheet and the opaque PVC sheets thus forms typically three pockets: a front pocket at the front of the binder, a rear pocket at the rear of the binder, and a spine pocket at the spine of the binder. A full size sheet of printed paper such as a report cover can be inserted into the front pocket; a spine-sized piece of paper can be inserted into the spine pocket for labeling the spine; and a full size sheet of printed paper or back cover can be inserted into the rear pocket, thus giving the binder a professional appearance and allowing the user to quickly determine the contents of the binder whether the binder is laying flat and closed on a desk or is placed upright on a bookshelf with only the spine and its label facing outward. Binders of this construction are sometimes called window binders or view binders. An example of such a view binder is shown in FIGS. 1 and 2.

It can be difficult to label the spines of view binders. The clear,or transparent overlay underneath which the user is expected to slide a spine label typically clings somewhat tightly to the binder spine making insertion difficult, especially insertion of lightweight paper stock. Especially with spine labels made from lightweight paper stock, users sometimes resort to opening the binder and laying it flat on a surface such as a table in order to relieve sufficient pressure at the clear cover over the spine in order to allow insertion of the spine label into the spine window. Laying the binder flat is particularly difficult when the binder is full. Also, removing the label from the spine window in order to re-label the binder spine can be very difficult because of the tight fit of the label into the spine window and the friction created thereby.

SUMMARY OF THE INVENTION

The present invention seeks to facilitate the process of binder spine identification by making the process of inserting and removing a spine label into a view binder easier. By creating a relief or void in the spine board the friction is reduced, thus allowing for an easier insertion of the paper or card stock insert.

The invention is of an improved binder which has been modified to create a depression therein such that the spine label can be more easily inserted into the spine window. The depression in the spine allows the opaque flexible sheet covering the spine to depress inwardly, thereby giving additional room for the spine label and decreasing the insertion force of the spine label into the spine window.

In one embodiment, the spine panel is a generally flat sheet but has raised rails along the lengthwise edges of the spine panel. In another embodiment, the spine panel has raised rails along three or all four sides. In yet another embodiment, the spine is stamped so as to create raised rails or creases near the lengthwise edges. In yet further embodiments, the spine panel has a curved or angled cross-section. In one aspect therefore, the invention is of a binder having a spine construction for easy insertion of a spine label, the binder including a front panel and a rear panel; a spine panel, an outer surface of the spine panel having a first raised portion, a second raised portion, and a relatively lower inner portion located between the first and second raised portions; at least one flexible opaque sheet covering the first and second raised portions and the lower inner portion; a flexible transparent or translucent sheet disposed over at least a portion of the spine panel and at least a portion of the opaque sheet, the transparent sheet and the opaque sheet together defining a spine pocket; wherein the lower inner portion of the spine panel allows a portion of the opaque sheet to deflect inward toward the interior portion and away from the transparent sheet, thereby reducing the amount of force necessary to slide a spine label into the spine pocket. The opaque sheet may be a pigmented vinyl sheet and the transparent sheet may be a transparent plastic sheet, which are all sealed together such as by heat, sealing, RF welding, ultrasonic welding, or other techniques, along the lines between the spine panel and the front panel, and between the spine panel and the rear panel, thus forming two plastic flexible hinges for the binder. The spine may be shaped in any one of a number of ways to produce the relatively raised portions and the relatively depressed portion, including by molding, routing, or stamping. A typical application for the invention would be for use in a ring binder such as a three ring binder although the invention could be used in other applications as well. The spine panel and front and cover panels could be chipboard such as is commonly used in three ring binders. However, other materials such as injection molded plastic or other rigid or semi-rigid materials could be used to make the panels.

In addition to making it easier to insert a spine label, another advantage of the improved binder of the present invention is that the binder is more likely to be able to be used a second time, a third time, or more. In prior art view binders, the transparent plastic sheet pressed tightly up against the spine label when the binder was closed. For certain types of printed spine labels such as laser printed spine labels, the transparent plastic sheet being pressed tightly up against the spine label over time tended to make the toner or other ink on the spine label adhere or be infused into the clear plastic sheet. This had the double effect of first making removal of the spine label extremely difficult because it was effectively lightly glued into the spine window, and second even if the spine label were successfully removed, toner or ink from the spine label would remain behind on the clear plastic sheet. The resulting ghost image of the old spine label remaining on the spine window partially obscured any new spine label Which was inserted into the spine window, and made the binder unsightly and unprofessional looking. Prior art view binders therefore were often simply discarded after they had been used a first time, rather than being refilled with different contents and used a second time.

By contrast, by relieving pressure of the clear plastic sheet on the spine label, the present invention helps to prevent the spine label ink or toner from sticking to the clear plastic sheet. This not only makes the spine label significantly easier to remove especially after the spine label has been inserted for a long period of time, but increases the likelihood that the spine label will be able to be successfully removed without leaving a ghost image of the first label behind. This increases the likelihood that the binder will be used a second time, a third time, or more times, thus effectively increasing the average useful life of the binder and making it more environmentally friendly.

Exemplary embodiments of the invention will be further described below with reference to the drawings, in which like numbers refer to like parts.

DETAILED DESCRIPTION OF EXEMPLARY EMBODIMENTS

Figure 1:
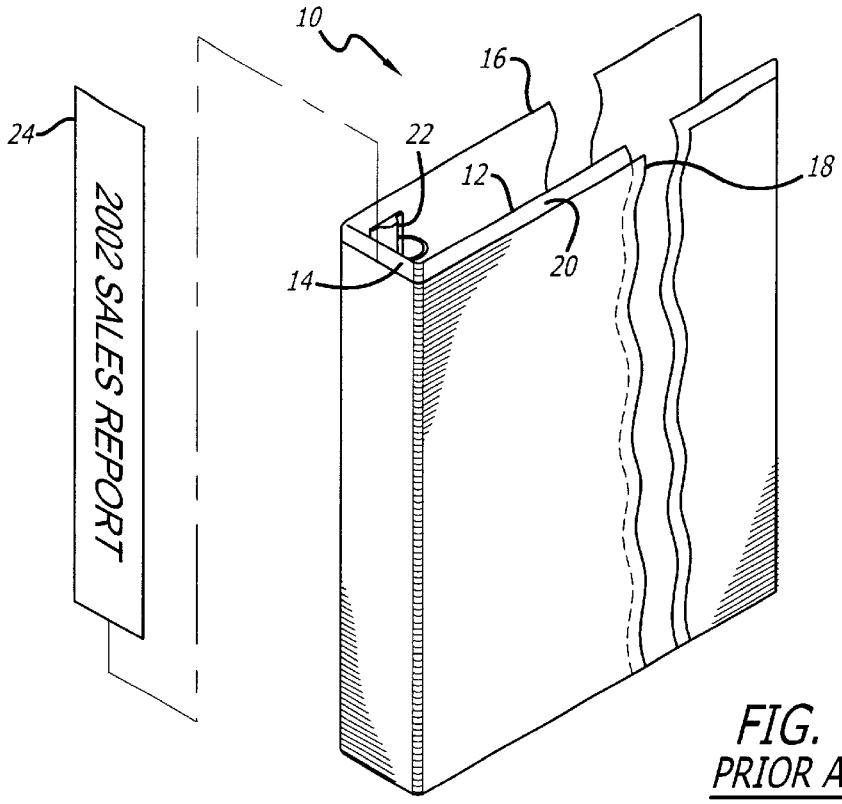
FIG. 1 PRIOR ART
FIG. 1 is a partial fragmentary view of a prior art window binder and a spine label for insertion into the spine window.

FIG. 1 shows a prior art binder of the plastic window binder or view binder variety. The binder 10 includes front cover 12, rear cover 16, and spine cover 14. A flexible transparent sheet 18 such as a clear plastic sheet covers nearly the entirety of the outside of the binder. Typically, there is a small gap between the top of the clear plastic sheet 18 and the top of the panels 12, 14 and 16 to conveniently insert a label into the gaps between those panels and clear plastic sheet 18. Typically, a printed sheet such as a full sized 8½×11 or A4 sheet is slid into the front panel window 20, and a narrower spine label 24 is slid into the spine window. Similarly, a full size sheet can be slid into the rear panel window. The labels for the windows can be paper of standard thickness, or could be card stock or other thicker material. The binder shown includes a three ring binder mechanism 22 for binding individual sheets of paper Within binder 10.

Figure 2:
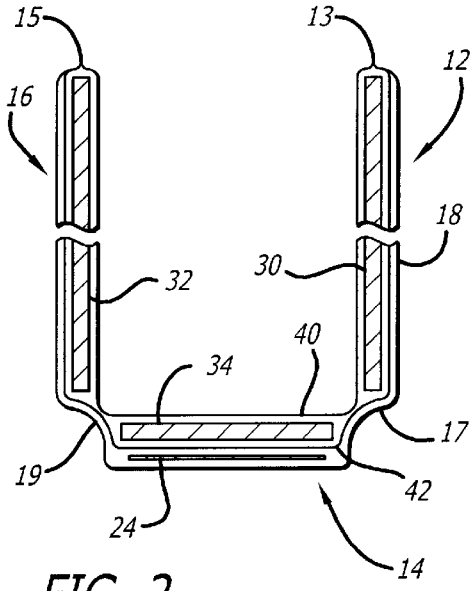
FIG. 2 PRIOR ART
FIG. 2 is a top cutaway partial fragmentary view of the prior art binder of FIG. 1 with the spine label inserted into the spine window.

FIG. 2 is a top cutaway view of the prior art binder of FIG. 1. Front panel 30, rear panel 32, and spine panel 34 are sandwiched between two sheets 40 and 42 of flexible material such as pigmented vinyl or other well-known suitable materials. Clear plastic sheet 18 covers most of the exterior of the binder. The two opaque vinyl sheets 40 and 42 and the clear plastic sheet 18 are sealed together at the ends 13 and 15 of the front and rear covers 12 and 16, respectively, and are further sealed together at points 17 and 19 to form flexible hinges for the binder. The sheets are sealed together by heat sealing, RF welding, thermosonic welding, or other known techniques. Paper spine label 24 is shown inserted into the spine window defined by the gap between outer opaque sheet 42 and clear sheet 18 in the spinal area. The gap between opaque sheet 42 and clear sheet 18 is exaggerated for illustration purposes. Similarly, the gap between opaque sheet 142 and clear sheet 144 in FIG. 3 is exaggerated for illustration purposes.

Figure 3:
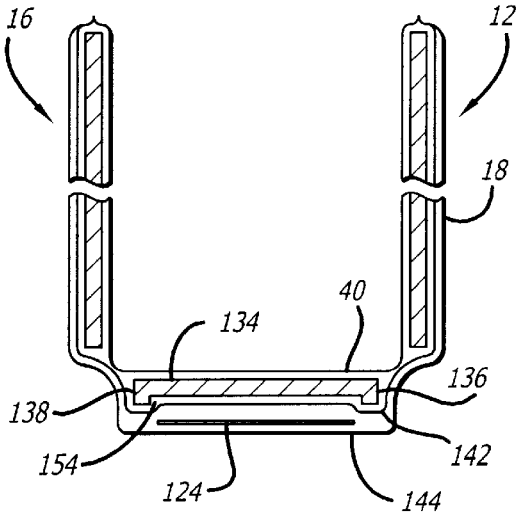
FIG. 3 is a top cutaway partial fragmentary view of a binder constructed according to a first embodiment of the present invention.

FIG. 3 is a top cutaway view of a binder having a depression in its spine for easy insertion of the spine label according to a first embodiment of the present invention. The ring mechanism is omitted for clarity of illustration. The spine panel 134 is altered to create a depression 154. In this embodiment, spine panel 134 is constructed of a generally flat member but having raised rails 136 and 138 along its edges. Flexible opaque sheet 142 therefore can bend inward slightly toward the depression, thus creating a larger gap between flexible opaque sheet 142 and transparent sheet 144 to accommodate spine label 124 and allow it to be slid in and out of the spine window with less friction than in the prior art binder of FIG. 2.

Figure 4:
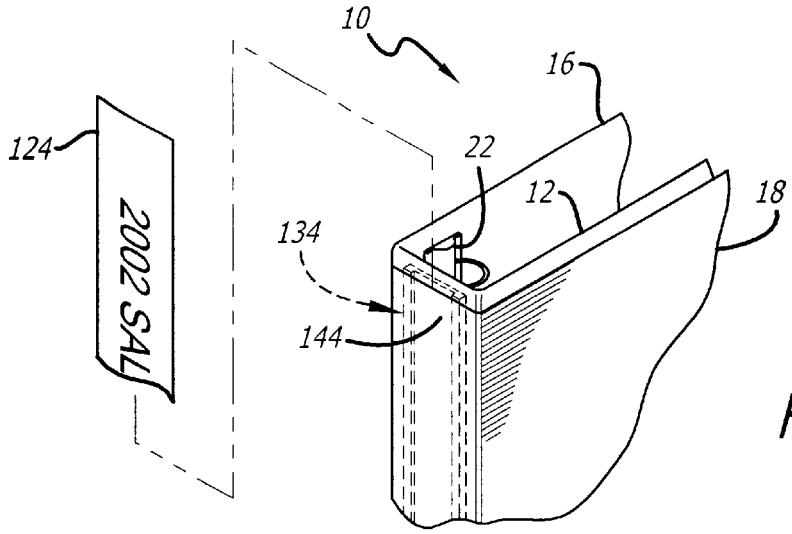
FIG. 4 is a perspective cutaway view of the binder of FIG. 3, with the spine panel member shown in phantom.

FIG. 4 is a perspective view of the binder of FIG. 3, showing the depression 154 in the spine in phantom. The depression in the spine is generally not visible because it is covered by opaque sheet 142.

Figure 5:
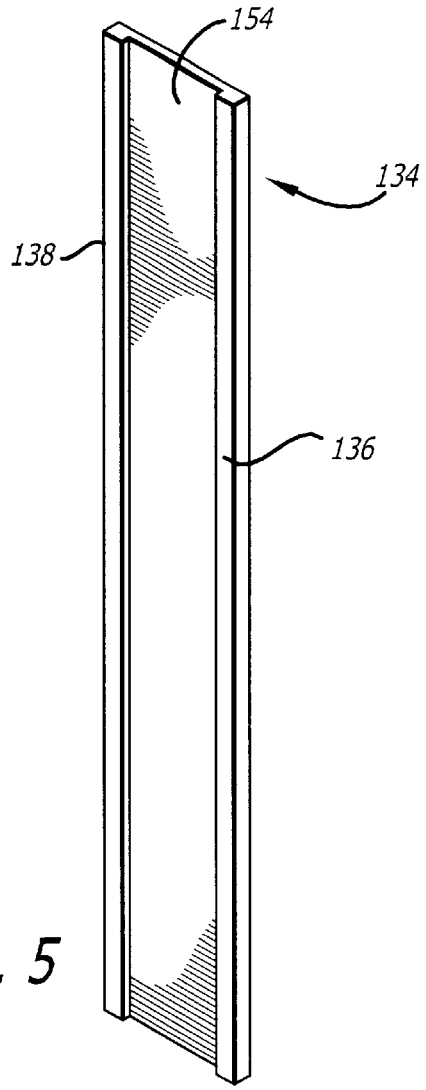
FIG. 5 is a perspective view of the spine panel of the binder If FIG. 4.

FIG. 5 shows just the spine panel 134 of the binder of FIG. 3. Spine panel 134 includes raised rails 136 and 138 along the edges, and depression 154 in the lateral center of the spine member.

Figure 6:
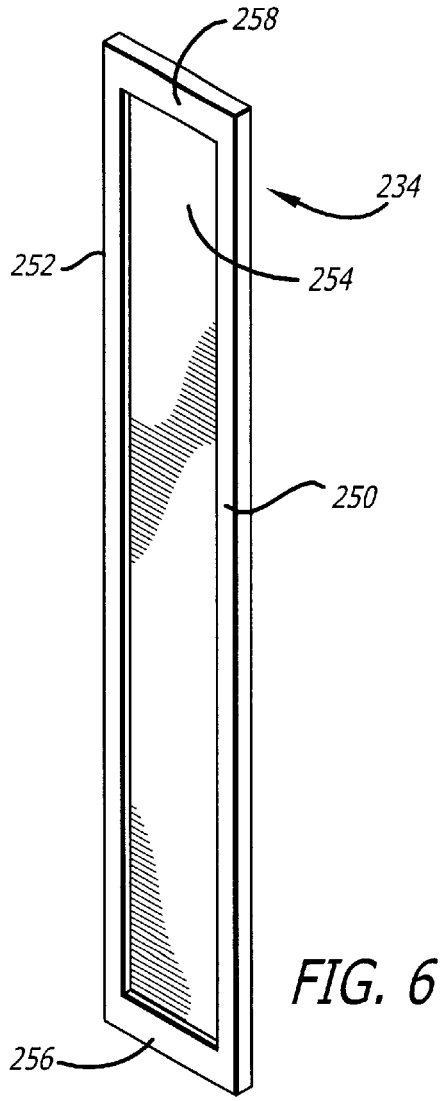
FIG. 6 is a perspective view of a spine panel for a binder according to a second embodiment of the present invention.

FIG. 6 shows a second embodiment of a spine panel according to the present invention. Spine panel 234 includes a relatively depressed area 254 and relatively raised areas along all four sides of the spine panel. This spine panel has raised side rails 250 and 252, and raised top and bottom rails 256 and 258. This embodiment would give the spine greater strength along the tops and bottoms of the spine panel and at the corners of the spine panel, thus allowing the binder to take more punishment such as being dropped on the corners or the top and bottom of the spine while suffering less damage.

Alternatively, the spine panel could have raised rails only along the sides and the bottom. In such a configuration, the spine panel would be as strong along its bottom as the spine panel of FIG. 6, but the binder would allow for as easy insertion of the spine label into the spine window as would a binder that employed the spine panel of FIG. 5. The spine panel shown in FIGS. 5 and 6 could be formed by routing or by molding.

Figure 7:
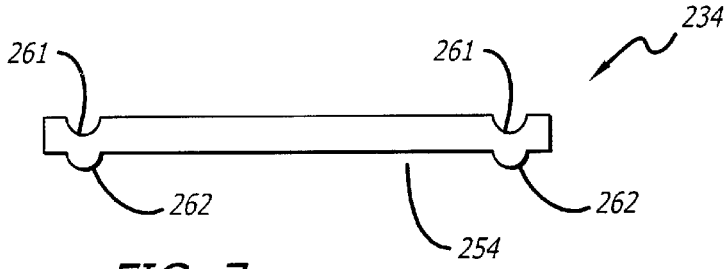
FIG. 7 is a cross sectional view of a spine panel for a binder according to a third embodiment of the present invention.

FIG. 7 shows the cross-section of a spine panel 234 according to another embodiment of the present invention. In this embodiment, spine panel 234 is stamped with a form or otherwise modified near its lengthwise edges so as to create two creases or bumps 262 near the edges, thereby creating depression 254.

Figure 8:
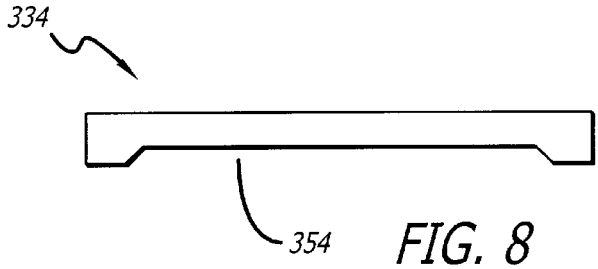
FIG. 8 is a cross sectional view of a spine panel for a binder according to a fourth embodiment of the present invention.

FIG. 8 shows a cross-section of a spine panel according to another embodiment of the present invention. Such a spine panel could be formed by applying a form under sufficient pressure such as by stamping, rolling, or pressing to create a depressed area 354 within spine panel 334.

Figure 9:
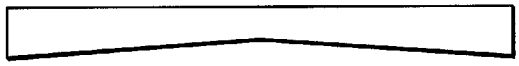
FIG. 9 is a cross sectional view of a spine panel for a binder according to a fifth embodiment of the present invention.

FIG. 9 shows a cross-section of a spine panel according to yet another embodiment of the present invention, in which the outwardly facing surface of the spine panel is angled.

Figure 10:
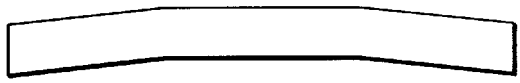
FIG. 10 is a cross sectional view of a spine panel for a binder according to a sixth embodiment of the present invention.

FIG. 10 shows a cross-section of a spine panel according to a further embodiment of the present invention, in which the spine panel has several slightly angled sections.

Figure 11:
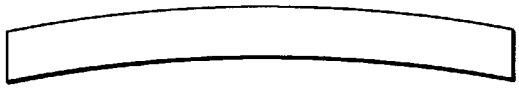
FIG. 11 is a cross sectional view of a spine panel for a binder according to a seventh embodiment of the present invention.

FIG. 11 shows a cross-section of a spine panel according to a still further embodiment of the present invention, in which the outwardly facing surface of the spine panel has a generally concave shape, and the spine panel has a generally uniform cross sectional thickness. The spine panels of FIGS. 10 and 11 might be formed, for example, by beginning with a flat sheet of material and inducing a permanent bend or bends in it, such as by bending under heat and pressure, and optionally adding a stiffening matrix to the material if the material is relatively weak and porous.

Figure 12:
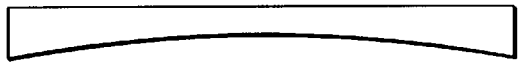
FIG. 12 is a cross sectional view of a spine panel for a binder according to an eighth embodiment of the present invention.

FIG. 12 shows a cross-section of a spine panel according to a still further embodiment of the present invention, in which the outwardly facing surf ace of the spine panel has a generally concave shape, and the inwardly facing surface of the spine panel is generally flat.

Figure 13:
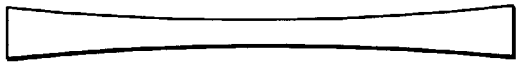
FIG. 13 is a cross sectional view of a spine panel for a binder according to a ninth embodiment of the present invention.

FIG. 13 shows a cross-section of a spine panel according to yet another embodiment of the present invention, in which both the inwardly and outwardly facing surfaces of the spine panel have generally concave shapes.

In all of the illustrative embodiments depicted, the spine panels have relatively raised outer portions and relatively depressed inner portions, such that the opaque plastic sheeting covering the spine panel can deflect inwardly away from the clear plastic window, thus increasing the clearance between the opaque plastic sheet and the clear plastic sheet. This allows a spine label or other identifying indicia to be inserted and removed more easily. In the figures, the thickness of the spine panel is generally exaggerated for illustration purposes.

In FIG. 3, spine label 124 is shown as being narrower than depressed area 154 in spine panel 134. It is not strictly necessary that the spine label be narrower than the depressed area within the spine panel. For example, spine label 124 could extend essentially the entire width of spine panel 134. In such a case, the outer edges of spine label 124 would rest on the raised rails 136 and 138 of spine panel 134 thus creating relatively high friction similar to prior art binders in that limited area. However, the remainder of spine label 124 would have relatively low friction, because the pressure between clear plastic sheet 144 and opaque sheet 142 would be relieved by the depression 154 within spine panel 134. Thus, even if spine label 124 extended substantially the entire width of spine panel 134, spine label 124 could still be inserted within the spine window with significantly lower friction as compared to prior art binders.

It will be appreciated that the term "present invention" as used herein should not be construed to mean that only a single invention having a single essential element or group of elements is presented. Although the present invention has thus been described in detail with regard to the preferred embodiments and drawings thereof, it should be apparent to those skilled in the art that various adaptations and modifications of the present invention may be accomplished without departing from the spirit and the scope of the invention. For example, the panel members could be made of various materials and formed according to various methods including but not limited to stamping, rolling, bending, routing, and injection molding; the flexible sheets could be made of various materials; and the flexible sheets could be sealed together according to various methods. A three ring binder mechanism could be affixed to the rear cover panel as shown in FIG. 4 and as is commonly practiced, but could also be affixed to the spine as is also commonly practiced. The binder need not be a three ring binder, and need not be designed for holding only paper but could be used to display and hold other objects such as cassette tapes, product samples, and other objects. In a product holder, the cassette tapes or other products could be held within shaped recesses on the insides of the front and rear covers. The binder need not be formed of three panels only, but could be a folding mechanism having virtually any number of panels. Thus, it will be understood that the term "binder" as used herein need not refer to a paper binder, but refers more generally to any multi-paneled folding mechanism having a window through which identifying indicia may be viewed. It will be also understood that the word "opaque" as used herein need not mean completely absorbing of light, but includes sheets that absorb enough of the light so as to be suitable for use as binder panel covers. Similarly, the word transparent as used herein need not mean transmitting one hundred percent of the light without visual distortion within particular frequencies, but can mean transmitting most of the light with a small is enough amount of visual distortion such that identifying indicia underneath remains sufficiently legible for labeling purposes. Accordingly, it is to be understood that the detailed description and the accompanying drawings as set forth hereinabove are not intended to limit the breadth of the present invention, which should be inferred only from the following claims and their appropriately construed legal equivalents.

What is claimed is:

1. A binder having a spine construction for easy insertion of a spine label, comprising:

a front panel and a rear panel;

a spine panel, an outer surface of said spine panel having a first raised portion, a second raised portion, and a relatively lower inner portion located between said first and second raised portions;

at least one flexible opaque sheet covering said first and second raised portions and said lower inner portion;

a flexible transparent sheet disposed over at least a portion of said spine panel and at least a portion of said opaque sheet, said transparent sheet and said opaque sheet together defining a spine pocket;

wherein the lower inner portion of the spine panel allows a portion of the opaque sheet to deflect inwards toward the interior portion and away from the transparent sheet, thereby reducing an amount of force necessary to slide a spine label into the spine pocket.

2. The binder according to claim 1 wherein said opaque sheet is a pigmented vinyl sheet.

3. The binder according to claim 2 wherein said opaque sheet and said transparent sheet are sealed together along a first line to form a first hinge connecting said front panel to said spine, and are welded together along a second line to form a second hinge connecting said rear panel to said spine.

4. The binder according to claim 1 wherein said spine panel is shaped to produce said first and second raised portions and said lower inner portion by molding.

5. The binder according to claim 1 wherein said spine panel is shaped to produce said first and second raised portions and said lower inner portion by applying a form to said spine panel under pressure.

6. The binder according to claim 1 wherein said spine panel is shaped to produce said first and second raised portions and said lower inner portion by routing.

7. The binder according to claim 1 wherein said spine panel is shaped to produce said first and second raised portions and said lower inner portion by bending said spine.

8. The binder according to claim 1 wherein said binder is a ring binder.

9. The binder according to claim 1 wherein said spine panel comprises chipboard.

10. The binder according to claim 1 wherein said spine panel comprises plastic.

11. The binder according to claim 1 wherein said binder is a window binder having at least said spine pocket and a front cover window pocket.

12. In a binder having a front panel, a rear panel, a spine, first and second generally opaque sheets covering said panels and said spine on opposite sides thereof, a transparent sheet over one of said opaque sheets; hinges formed between said panels and said spine by sealing together a portion of said first and second opaque sheets and said transparent sheet, and a spine pocket between said first opaque sheet and said transparent sheet, the improvement comprising:

forming a depression in said spine underneath the spine pocket in order to allow a spine label to be more easily inserted into the spine pocket.

13. The binder according to claim 12 wherein said depression is a concave depression.

14. The binder according to claim 12 wherein said binder is of the window binder type wherein:

said first and second opaque sheets are sealed together to sandwich said front and rear panels and said spine therebetween;

said first and second opaque sheets and said transparent sheet are sealed together along first and second lines to form first and second hinges for said binder;

said transparent sheet is sealed to said first opaque sheet along a bottom thereof to form pockets defining a front window and a spine window for insertion of indicia bearing media therein.

15. The binder according to claim 14 wherein said hinges are formed by heat sealing.

16. A binder comprising:

a front panel and a rear panel;

a spine having a depressed area at its center relative to portions peripheral to said depression;

an opaque flexible sheet covering said depression and said peripheral portions of said spine;

a transparent flexible sheet at least partially covering said opaque sheet;

wherein a label may be inserted between said transparent sheet and said opaque sheet, said depression acting to relieve pressure between said transparent sheet and said opaque sheet thereby facilitating easy insertion of said label.

17. The binder according to claim 16 wherein said peripheral portions are higher than said depressed area along at least left and right edges of said spine.

18. The binder according to claim 16 wherein said peripheral portions are higher than said depressed area along left and right edges of said spine and along a bottom edge of said spine.

19. The binder according to claim 16 wherein said spine is thinner in said depressed area than at said peripheral portions.

20. The binder according to claim 16 further comprising a spine label disposed between said transparent sheet and said opaque sheet, said spine label being narrower than said depressed area.

21. The binder according to claim 16 further comprising a spine label disposed between said transparent sheet and said opaque sheet, said spine label being wider than said depressed area.

22. The binder according to claim 16 wherein said front and rear panels have recesses for holding objects therein.

* * * * *